United States Patent [19]

Röper

[11] Patent Number: 4,519,574

[45] Date of Patent: May 28, 1985

[54] AUXILIARY CONTROLLED VALVE DISPOSED IN A DRILLING STRING

[75] Inventor: Rudolf Röper, Dortmund, Fed. Rep. of Germany

[73] Assignee: Norton Christensen, Inc., Salt Lake City, Utah

[21] Appl. No.: 519,422

[22] Filed: Aug. 1, 1983

[30] Foreign Application Priority Data

Sep. 14, 1982 [DE] Fed. Rep. of Germany ..... 3233982

[51] Int. Cl.[3] ..... F16K 31/12

[52] U.S. Cl. ..... 251/31; 251/24; 251/37; 251/63.5; 251/127; 137/219; 137/599; 138/40; 166/319; 367/85

[58] Field of Search ..... 251/33, 37, 63, 63.5, 251/63.6, 117, 282, 123, 127, 24, 31, 43; 324/356, 369; 166/319; 137/219, 599; 367/85; 138/37, 40, 44

[56] References Cited

U.S. PATENT DOCUMENTS

| | | | |
|---|---|---|---|
| 1,763,286 | 6/1930 | Wilman | 251/127 |
| 2,651,325 | 9/1953 | Lusignan | 251/31 |
| 2,772,691 | 12/1956 | Hoffman | 137/599 |
| 2,898,088 | 8/1959 | Alder | 251/24 |
| 3,212,521 | 10/1965 | Jean | 251/127 |
| 3,693,428 | 9/1972 | Peuvedic et al. | 367/85 |
| 3,976,100 | 8/1976 | Souslin | 137/599 |
| 4,336,564 | 6/1982 | Wisniewski et al. | 367/85 |

FOREIGN PATENT DOCUMENTS

| | | | |
|---|---|---|---|
| 806787 | 12/1936 | France | 138/40 |
| 512895 | 2/1955 | Italy | 137/219 |
| 4427104 | 1/1965 | Japan | 251/31 |
| 35433 | 4/1970 | Norway | 251/33 |

*Primary Examiner*—Samuel Scott
*Assistant Examiner*—Noah P. Kamen
*Attorney, Agent, or Firm*—Walter Fred

[57] ABSTRACT

An auxiliary controlled valve including a valve body (8) displaceable against a valve seat (9) disposed in a drilling string (6) to produce pressure pulses in drilling fluid renders possible a selective closing or opening of a low-resistance transmission section (12) which lies parallel to a main throttle section (10). The valve has a central passage which permits the passage of measuring instruments through the valve regardless of the particular position of a valve body (8). The valve body (8) is largely balanced out with regard to dynamic flow forces so that only a comparatively small actuating force is necessary.

13 Claims, 6 Drawing Figures

AUXILIARY CONTROLLED VALVE DISPOSED IN A DRILLING STRING

TECHNICAL FIELD

The invention relates to an auxiliary controlled valve disposed in a drilling string and which is a component of a device for the remote transmission of information from a well to the surface of the earth wherein the flushing liquid flowing through the string serves as the transmitting medium.

BACKGROUND ART

A valve which has been proposed heretofore comprises a main valve body which can be brought against a valve seat by axial displacement in order to close a main passage for flushing liquid. Downstream, the main valve body merges into a cylindrical skirt which surrounds a stationary valve housing provided with a central passage and forms a chamber between the inner end face of the main valve body and the valve housing. This chamber is connected to a pressure probe which is disposed, directed upwards, on the main valve body and projects through a first auxiliary throttle section. Downstream, the chamber leads, behind a second auxiliary throttle section present in the flushing passage, into a region of the flushing passage situated further downstream. The flow connection leading from the chamber into the flushing passage can be closed by means of an auxiliary valve body. When the auxiliary valve body is closed, the difference in pressure forming between the chamber and the outer face of the main valve body and obtained via the pressure drop at the first auxiliary throttle section, causes a closing of the main valve body, but when the auxiliary valve body is open, on the other hand, the reverse difference in pressure obtained via the pressure drop at the second auxiliary throttle section causes an opening of the main valve body.

In this known valve, the main valve body, pressure probe, valve housing and auxiliary valve body are disposed in the centre of the pipe string, while the main passage for the flushing liquid is deflected outwards and surrounds the valve arrangement as an annular chamber. It is not possible for measuring instruments let down through the flushing passage to pass the valve arrangement. Such measuring instruments are used, for example, in the case of a jammed drilling string, to seek the jamming point and the nearest free threaded connection above it, in order to loosen this by means of an explosive charge, under initial tension with a torque directed in the opening sense.

Now, such a valve with the other associated parts of the device for data transmission and the drill stems of non-magnetic material necessary for the magnetic determination of direction represent such a valuable object that in the event of jamming of the drilling string it is worth striving the save these parts. If the jamming point lies below the part of the string which receives the device for data transmission, however, the last free threaded connection must be accessible for this.

It is an object of the present invention to develop a valve of this character which can be passed by the equipment, which can be introduced into the flushing passage and can be reliably actuated by the control device which is restricted to a smaller space as a result of this requirement.

SUMMARY OF THE INVENTION

The present invention is an auxiliary controlled valve disposed in a drilling string to produce pressure pulses in the flushing liquid flowing downwards through the string, the bit and upwards through an annular chamber. The valve comprises a main throttle section, a low-resistance transmiision section connected in parallel thereto and which can be closed by means of a valve body displaceable against a valve seat by a piston which is guided in a presure chamber and connected to the valve body and an auxiliary throttle section to obtain a pressure difference for the actuation of the piston. Also, the auxiliary throttle section, the valve body and the main throttle section each have a rectilinear passage forming a common axis, the surfaces adjacent to one another formed by valve body and valve seat form a continous course adapted to the boundary layer of the flow of flushing liquid and ensuring a flow largely free of flow separation and the valve body is provided with a device to compensate for the dynamic flow forces.

As a result of the rectilianear passage through auxiliary throttle section, valve body and main throttle section, measuring instruments can be taken through the valve regardless of the position of the main valve body. The formation of the surfaces formed by valve body and valve seat according to the course of the boundary layer of the flushing liquid ensures a flow substantially free of flow separation and contributes to the stabilization of the forces acting on the valve during its closing or opening stroke. The risk of valve flutter is avoided as a result. In order to compensate for the dynamic flow forces which arise as a result of the increased velocity of flow in the region between valve body and valve seat and which cause a closing tendency of the valve body, a compensating device is provided which opposes forces directed oppositely to the dynamic flow forces. Thus, the actuating forces to be applied externally can be of an order of magnitude which can be mastered by the spatially restricted actuating device disposed coaxilaly round the free passage.

BRIEF DESCRIPTION OF THE DRAWINGS

Embodiments of the present invention will now be described, by way of example, with reference to the accompanying drawings, in which.

DESCRIPTION OF THE PREFERRED EMBODIMENT(S)

Figure 1:
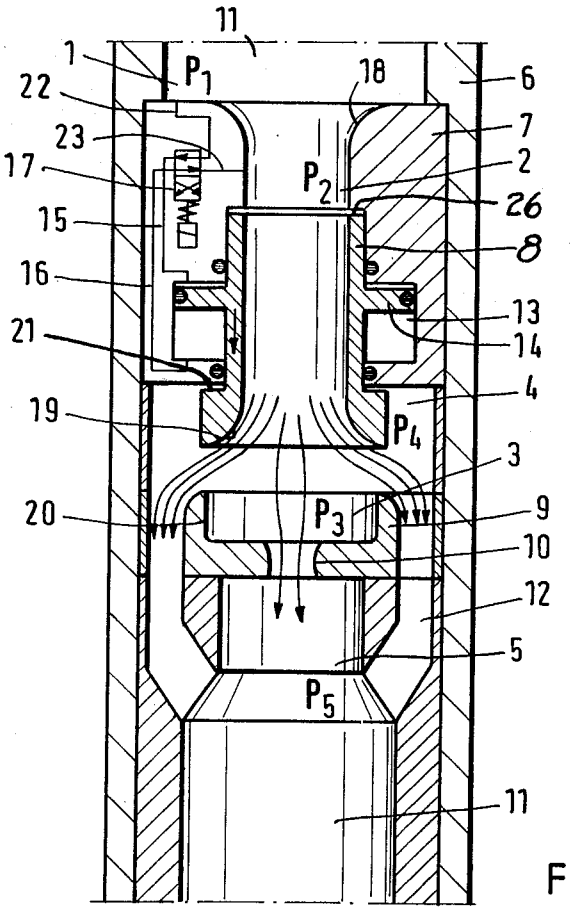
FIG. 1 is a cross sectional view of a valve which can be actuated in two directions, shown in the open position.

The valve in FIG. 1. which is disposed in a portion of a drilling string 6, comprises a valve housing 7 in which a valve body 8 is disposed for longitudinal movement. The valve body can be brought against a valve seat 9 by downwardly directed displacement. Below the valve seat 9 in the form of a constriction 10 is the main throttle section which leads into a central flushing passage 11. Extending parallel to the constriction 10 is an annular chamber 12 with a larger cross-section than that of the constriction 10. This annular chamber serves as a low-resistance passage and likewise leads into the flushing passage 11 below the constriction 10. The valve body 8 is surrounded by a pressure chamber 13 in which there is guided a piston 14 which is disposed on and connected to the valve body 8. Leading into the upper and lower portions of the pressure chamber 13 are pressure-fluid passages 15, 16 which are connected by an auxiliary valve 17 (schematically shown) driven electromagnetically or by an electric motor, to the inlet 18 of the valve housing 7, which inlet is formed as a nozzle and serves as an auxiliary throttle section. A passage 22 for the inlet of pressure fluid is connected to a region 1 of the central flushing passage 11 directed upstream with a high pressure level $P_1$, while a passage 23 for the outlet of pressure fluid leads into a region 2 in which the cross-section is constricted and consequently the lower pressure level $P_2$ in comparison with $P_1$ prevails. In the position illustrated of the auxiliary valve, a higher pressure is therefore present in the upper region of the pressure chamber 13 than in the lower region, and exerts a force directed downstream on the piston 14 (see arrow). The valve body is therefore in the process of executing a closing movement.

Below the valve body there is a region 3 in which a pressure $P_3$ which is only slightly different from $P_2$ prevails when the valve is open. In this region, the flushing liquid flowing past is divided into a large component which flows through the annular chamber 12 and a small component which passes through the constriction 10.

In a region 5 below the constriction 10, the flows through both the annular chamber 12 and the constriction 10 are united and flow jointly further on through the flushing passage 11. Since the constriction 10 is bypassed by the low-resistance annular chamber 12, only a small pressure drop occurs, so that the pressure level $P_5$ in the region 5 is only a little below the pressure level $P_3$ in the region 3. The pressure $P_4$ in the upper region 4 of the annular chamber 12 is also at the same level. When the valve body is in the open state, the total pressure drop across the valve only corresponds to the pressure drop $P_1-P_2$ across the auxiliary throttle section. The valve body is not exposed to any axial forces caused by the flow.

Figure 2:
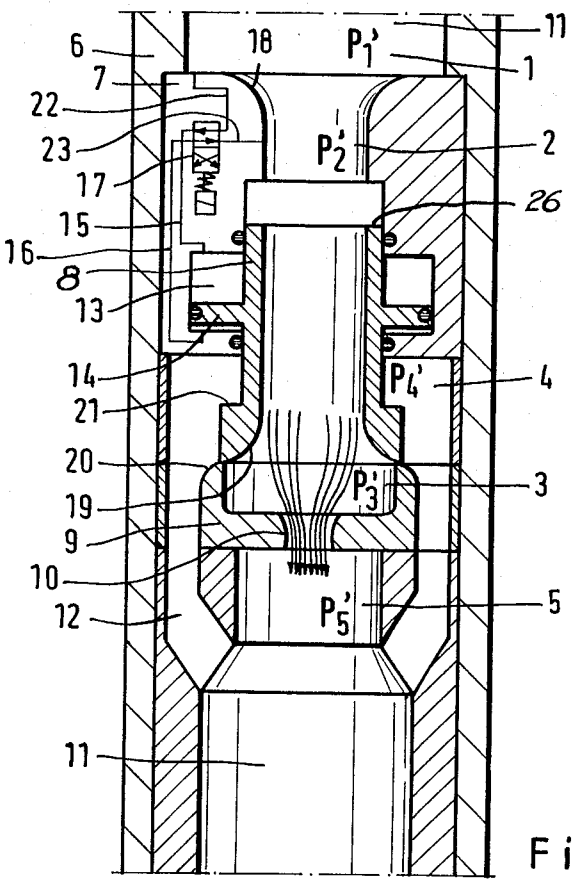
FIG. 2 shows the valve of FIG. 1 in the closed position.

The closed state of the valve body is illustrated in FIG. 2. The flushing liquid is no longer divided into two components in the region 3 and instead the whole flow must pass through the construction 10. On the assumption that the same amount of flushing liquid flows through the valve per unit of time in the closed and in the open state, the same pressure level ($P'_5=P_5$) always results in the region 5 of the constriction 10, but a pressure rise ($P'_3>P_3$) occurs in the region 3 with the valve closed. $P'_2$ is also increased in relation to $P_2$ and $P'_1$ in relation to $P_1$ by the same amount as $P'_3$ in relation to $P_3$.

The total pressure drop across the valve is composed of the sum of the pressure drops $P'_1-P'_2$ and $P'_3-P'_5$.

If the valve body 8 has lifted slightly from its valve seat 9, or if there is a leakage flow, a high velocity of flow prevails in the gap formed therebetween, caused by the difference pressure $P'_3-P'_4$ between the regions 3 and 4. The pressure $P'_4$ in the region 4 is equal to the pressure $P'_5$ in the region 5. The pressure drop occurring as a result of the high velocity of flow causes a reaction force, directed axially towards one another, between the end faces 19 and 20 of the valve body 8 and valve seat 9. Thus, the valve body 8 always tends to move from a partially open position into an almost closed one. In order to stabilize the reactions occurring between these end faces, which form a sealing edge when the valve is closed, their course is adapted to the boundary layer developing during the flow through. Then, no flow separation occurs in the region of the radial intersection or overlaping portions of valve body 8 and valve seat 9, which might cause an unstable pressure region for example.

In order to compensate for the reaction force acting in the closing direction, a projection on the valve body is provided with a surface 21 facing in the upstream opening direction. This surface may also be made tapered because it is only a question of the radial component. A force facing in the opening direction, which is directed counter to the closing force and is in a position to compensate for this forms between this surface 21 adjacent to the region 4 of the annular chamber 12 and so acted upon by the pressure $P'_4$ and the oppositely directed surface 19 adjacent to the region 3 and so acted upon by the pressure $P'_3$. Since the closing force is dependent on the velocity of flow in the gap and the opening force on the pressure difference between $P'_3$ and $P'_4$ and there is a direct relation between pressure difference and velocity of flow in the gap, a substantial synchroism results between the two forces depending on the position of the valve body.

Figure 3:
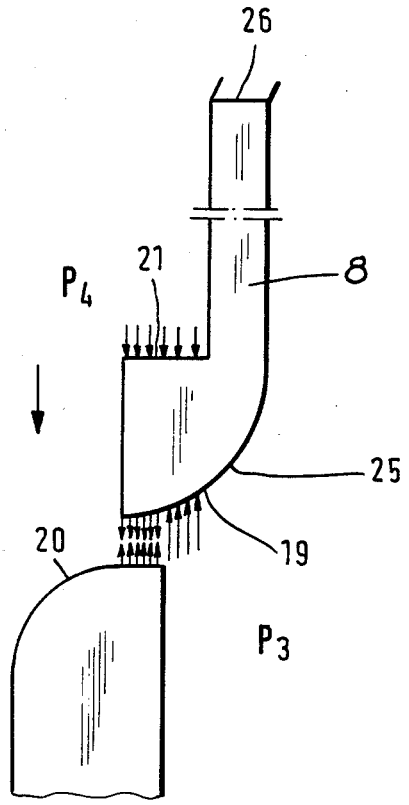
FIG. 3 is a schematic view of portions of the valve body and valve seat of the valve shown in FIGS. 1 and 2 and the forces acting thereon.

FIG. 3, as a detail drawing, illustrates how the compensation forces act on the valve body 8.

The illustration is restricted to the forces caused dynamically. The static forces acting on the directly opposite end surface portions 25 and 26 of the valve body 8 mutually cancel one another and are therefore not shown.

By effecting an over-compensation or under-compensation, the valve can be made self-opening or self-closing.

Figure 4:
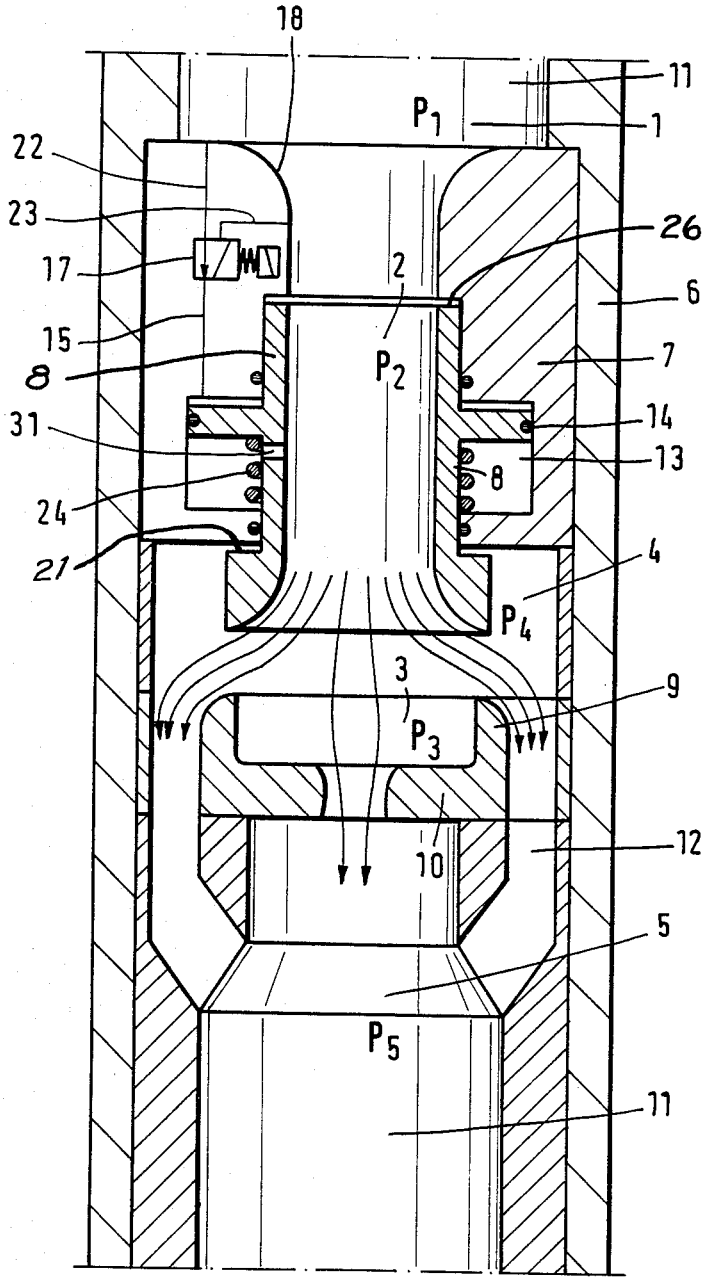
FIG. 4 is a cross sectional view of a similar valve modified so it can be actuated in one direction and which is provided with a restoring spring.

The valve illustrated in FIG. 4 differs from the one illustrated in FIGS. 1 and 2 with regard to the possible direction of actuation. The auxiliary valve 17 connects only the upper portion of the chamber 13 selectively to the higher pressure level in the region 1 or to the lower one in the region 2. The lower portion of the chamber 13 is constantly in communication with the interior of the valve body 8, in which the pressure $P_2$ prevails, through an equalizing passage 31. The restoring of the valve is effected through a restoring spring 24 at the moment when the upper portion of the chamber 13 is connected to the region 2.

Figure 5:
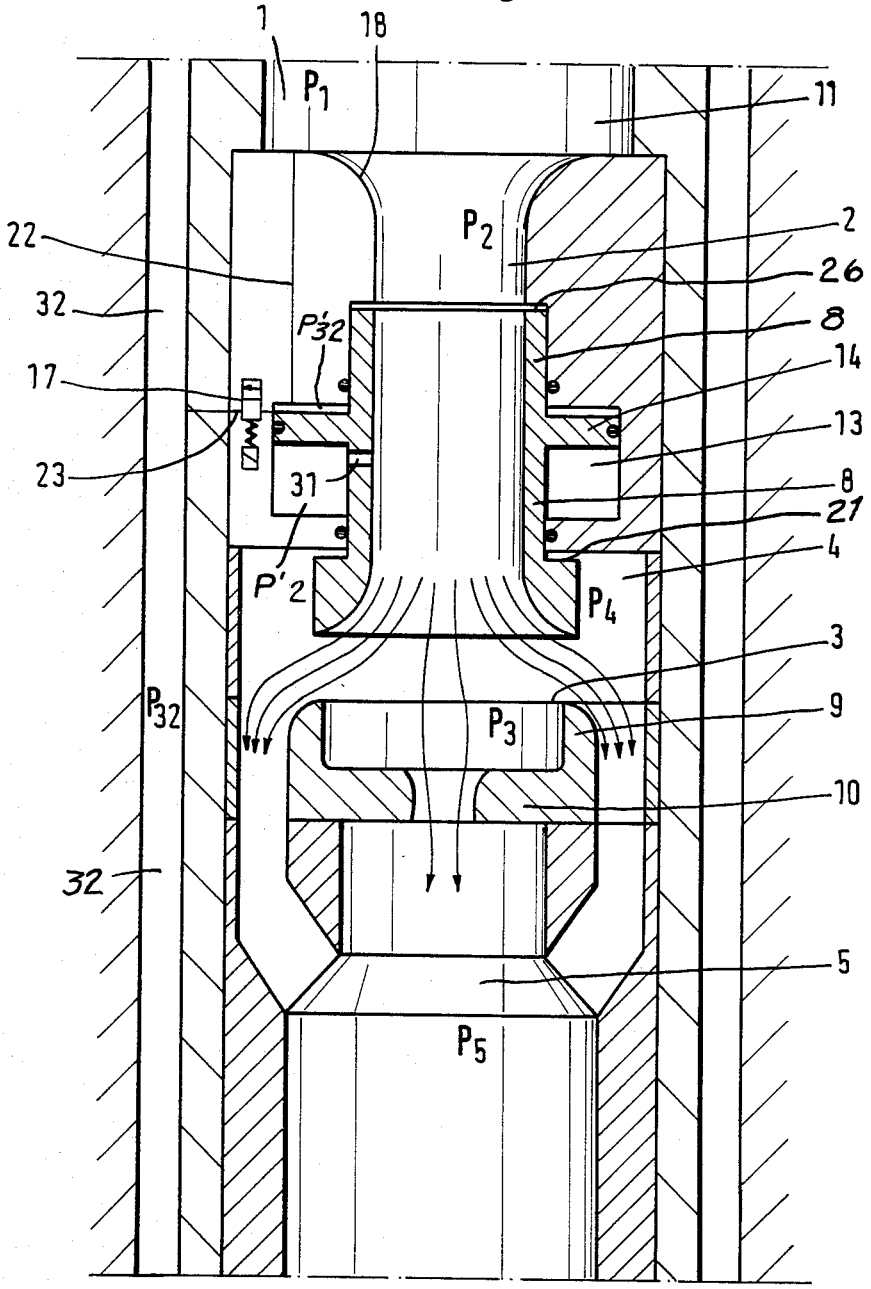
FIG. 5 is a cross-sectional view of a valve modified so it can be actuated in two directions and which uses the pressure level prevailing in the annular chamber for the restoring force.

The valve shown in FIG. 5 comprises a passage 22 for the inlet of pressure fluid which establishes a constant communication between the upper portion of the chamber 13 and the region 1 and a passage 23 for the outlet of the pressure fluid which connects the same portion of the chamber 13 to an annular chamber 32 of the drilling string, through an auxiliary valve 17. The lower portion of the chamber 13 is connected to the interior of the valve body 8 through the equalization passage 31 as in FIG. 4. When the auxiliary valve 17 is closed, the pressure difference $P_1-P_2$ between the regions 1 and 2 acting on the piston 14 leads to a closing of the valve body. When the auxiliary valve 17 is open, an intermediate level $P'_{32}$ which is distinctly below that in the region 2, develops in the upper portion of the chamber 13 as a result of the very low presure level $P_{32}$ in the annular chamber 32, which is caused by the pressure drop across the drill bit.

As a result of the inverse pressure difference $P'_2-P'_{32}$ acting on the piston 14 the valve therefore executes an opening operation.

Figure 6:
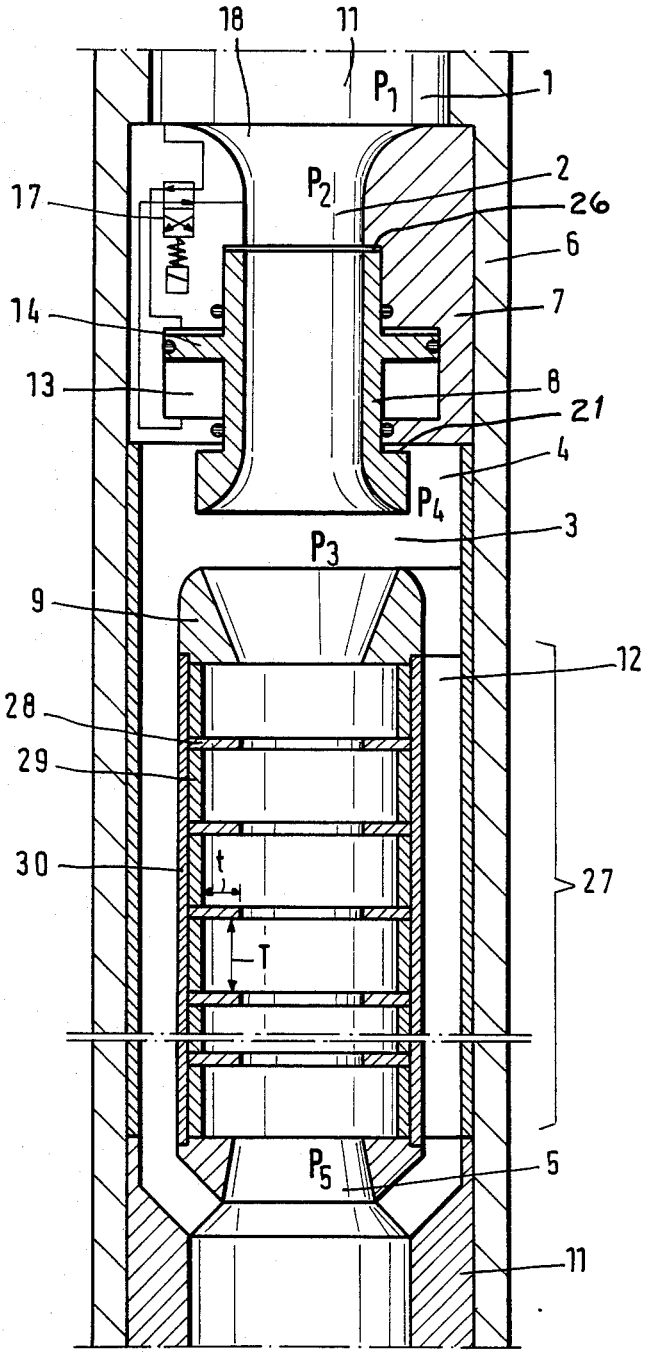
FIG. 6 is a cross-sectional view of a valve modified so it can be actuated in two directions, similar to FIGS. 1 and 2 and with a tubular means including annular grooves as a main throttle section.

If, in order to achieve the necessary pressure drop across the valve, the constriction 10 would have to have such a small cross-section that the measuring instruments introduced into the drilling string could not pass this region, a solution as shown in FIG. 6 may advantageously be selected. Here, the main throttle section consists of a tube or tubular section 27 having annular internal grooves and a plurality of axially spaced orifice rings 28 disposed therein in cascade fashion. The internal diameter of the orifice rings 28 and tube corresponds to the diameter of the inlet 18 and of the valve body 8. Situated between the orifice rings 28 are spacers or spacing members 29, the whole arrangement being held and centered in a carrier tube 30. The action of the tubes having annular grooves does not consist in a simple addition of the pressure drops across each individual orifice but rotational fields develop between the orifice rings and lead to a maximum flow resistance if the ratio of groove depth t to orifice spacing T is optimized. The absolute value can then be adjusted by appropriate deisgn of the length of the tube section having annular grooves.

I claim:

1. An auxiliary controlled valve disposed in a drilling string to produce pressure pulses in a flushing pressure fluid flowing downwards under pressure through a central passage of the string, the valve, a drill bit and upwards through an annular chamber, wherein the valve comprises: a main throttle section, a low-resistance transmission section including a chamber of constant cross section adjacent and connected in parallel to the main throttle section, a valve seat between the main throttle and low-resistance transmission sections, a longitudinally movable valve body adjacent to and displaceable downwardly against the valve seat to close off the low resistance transmission section, a piston guidedly mounted in a pressure chamber and connected to displace the valve body and be displaced by the pressure fluid in the central passage; and an auxiliary throttle section adjacent an inlet end of the valve adapted to obtain a pressure difference in the pressure fluid for actuating and displacing the piston and valve body, and wherein the auxiliary throttle section, the valve body, and the main throttle section each have a rectilinear passage about a common axis, the valve body and valve seat have surface means adjacent one another that form a continuous course so as to maintain a boundary layer of flow next to said surface means for ensuring a flow substantially free of flow separation and reduced valve flutter, and the valve body has compensating means responsive to the pressure of the fluid in the central passage and low resistance transmission section to compensate for dynamic flow forces.

2. A valve according to claim 1 wherein the compensating means comprises: a surface of the valve body which faces in a closing direction of the valve and can be acted upon by the pressure of the flushing pressure fluid in the central passage, and an outwardly projecting surface of the valve body which faces in an opening direction of the valve and which can be acted upon by the pressure of the flushing pressure fluid in the low-resistance transmission section.

3. A valve according to claim 1 wherein the valve body has an internal diameter about the rectilinear passage which is equal to that of the auxiliary throttle section.

4. A valve according to claim 1 wherein the piston and the pressure chamber extend coaxially around the valve body and the piston projects radially into the pressure chamber from a portion of the valve body.

5. A valve according to claim 1 wherein the pressure chamber has a region situated at each side of the piston which can be connected alternatively, by means of pressure-fluid passages and an auxiliary valve to an inlet passage for the pressure fluid respectively.

6. A valve according to claim 1 wherein the pressure chamber has a region situated at one side of the piston which can be connected alternatively to an inlet passage for the pressure fluid or an outlet passage for the pressure fluid by means of a pressure-fluid passage and an auxiliary valve, another region situated at the other side of the piston connected by an equilizing passage to the rectilinear passage, and spring means acting against the valve body for producing a restoring force sufficient to displace the valve body away from the valve seat and open the valve.

7. A valve according to claim 1 wherein the pressure chamber has a region situated at one side of the piston which can be connected to both an inlet passage for the pressure fluid and, by means including an auxiliary valve, to an outlet passage for the pressure fluid, and another region situated at the other side of the piston is connected by an equalizing passage to the rectilinear passage.

8. A valve according to claim 6 wherein the inlet passage for the pressure fluid is connected to a region of the central passage upstream of the auxiliary throttle section, and the outlet passage for the pressure fluid as well as the equalizing passage are connected to a region of the rectilinear passage downstream of the auxiliary throttle section.

9. A valve according to claim 7 wherein the inlet passage is connected to a region of the central passage upstream of the auxiliary throttle section, the equalizing passage is connected to a region of the rectilinear passage downstream of the auxiliary throttle section, and the outlet passage is connected to a region of the annular chamber around the drilling string.

10. A valve according to claim 1 wherein the auxiliary throttle section, the valve body and the main throttle section have the same internal diameter.

11. A valve according to claim 3 wherein the main throttle section comprises: tubular means including annular internal grooves situated between axially spaced orifice rings and an internal diameter equal to that of the auxiliary throttle section and the valve body.

12. A valve according to claim 11 wherein the tubular means further comprises: annular axial spacers between circumferential portions of the orifice rings, and a carrier tube extending around and holding the annular spacers and orifice rings therebetween.

13. A valve according to claim 11 wherein the annular internal grooves have a radial groove depth from the internal diameter of the orifice rings relative to the axial spacing of the orifice rings of a ratio selected to provide a maximum resistance to fluid flow through an orifice ring of a given internal diameter.

* * * * *